United States Patent [19]

Kondoh

[11] Patent Number: 4,619,178

[45] Date of Patent: Oct. 28, 1986

[54] STOP ANGLE CONTROLLER FOR A VIBRATO MECHANISM ON A VIBRAPHONE

[75] Inventor: Motoya Kondoh, Shizuoka, Japan

[73] Assignee: Nippon Gakki Seizo Kabushiki Kaisha, Japan

[21] Appl. No.: 764,429

[22] Filed: Aug. 9, 1985

[30] Foreign Application Priority Data

Aug. 10, 1984 [JP] Japan ..... 59-121872[U]
Aug. 10, 1984 [JP] Japan ..... 59-121873[U]
Jun. 21, 1985 [JP] Japan ..... 60-134307

[51] Int. Cl.[4] ..... G10D 13/08
[52] U.S. Cl. ..... 84/410
[58] Field of Search ..... 84/410

[56] References Cited

U.S. PATENT DOCUMENTS 3,138,986 6/1964 Musser ..... 84/410

*Primary Examiner*—L. T. Hix
*Assistant Examiner*—Douglas S. Lee
*Attorney, Agent, or Firm*—Ostrolenk, Faber, Gerb & Soffen

[57] ABSTRACT

In construction of a vibrato mechanism on a vibraphone, fans are stopped at a selected stop angle by deceleration of a drive motor through use of auxiliary current on a basis of angular position detection, correction in rotation of a drive motor on the basis of actual stop angle detection, or timed application of locking on a fan shaft, all for stoppage at a selected stop angle, thereby assuring uniform non-vibrato performance.

10 Claims, 16 Drawing Figures

STOP ANGLE CONTROLLER FOR A VIBRATO MECHANISM ON A VIBRAPHONE

BACKGROUND OF THE INVENTION

The present invention relates to stop angle controller for a vibrato mechanism on a vibraphone.

In general, a vibraphone includes a number of sound boards, each adjusted for a prescribed resonance frequency, which are juxtaposed on a base plate in the order of tonal pitch. Tones are generated by striking the sound boards by means of a mallet or mallets. Each sound board is accompanied with a resonator tube arranged beneath the bottom face of the sound board. Resonance of the air column in the resonator tube increases volume of the tone generated by the associated sound board. Further the resonance enriches sounds in the bass range thereby enlarging the tone range.

Being different from marimbas and xylophones, a vibraphone is equipped with a vibrato mechanism arranged near the top openings of the resonator tubes. More specifically, the vibrato mechanism includes a plurality of fans mounted to a common fan shaft which is coupled to a given drive source via a suitable power transmission. Each fan is located facing the top opening of each resonance tube. When the drive source is activated, the fans are driven for common rotation whereby vibrato performance is available.

At transition from vibrato to non-vibrato performance, the drive source is manually deactivated, but the fans continue to rotate due to inertia and, in general, stop at uncontrolled stop angle. In other words, the stop angle varies from transition to transition. The resonator tubes may be left open, half closed or fully closed depending on the condition of performance and/or the vibraphone at the moment of transition. Thus, no constant tone volume is expected for non-vibrator performance and, as a consequence, no constant performance effect can be expected.

SUMMARY OF THE INVENTION

It is the object of the present invention to stop rotation of fans of vibrato mechanism at a constant stop angle in order to assure constant performance effect during non-vibrato performance.

In accordance with one aspect of the present invention, a plurality of fans of a vibrato mechanism are driven for common rotation by a drive motor, the angular position of the fans is detected and a detection signal generated, and the operation of the drive motor is controlled in response to the detection signal to stop rotation of the fans at a selected stop angle.

In accordance with the other aspect of the present invention, a plurality of fans are mounted to a fan shaft which is coupled to a drive source via slippable power transmission, and means is provided for locking the fan shaft against rotation on manual operation through engagement with the fan shaft to stop its rotation at a selected stop angle.

DESCRIPTION OF THE PREFERRED EMBODIMENTS

Figure 1:
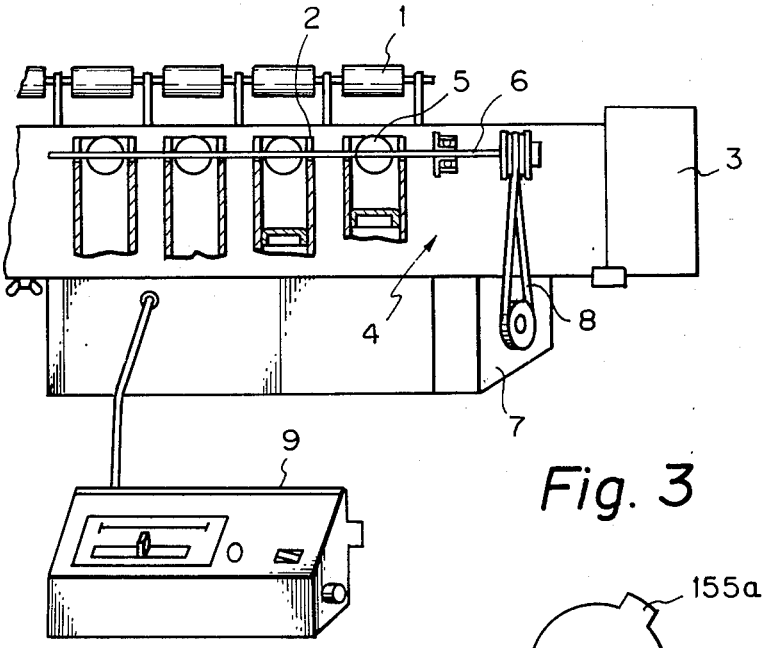
FIG. 1 is a perspective view of a vibraphone to which the present invention is applied.

A most usual example of the vibraphone is shown in FIG. 1 to which the present invention is well applicable. The vibraphone includes a number of sound boards 1 juxtaposed on a base plate 3. Each sound board 1 is associated with, a respective resonance tube 2 arranged beneath it. A vibrato mechanism 4 is provided and includes a number of fans 5 mounted to a commond fan shaft 6 which is coupled to a drive motor 7 via a proper power transmission 8. The drive motor 7 is electrically connected to a control box 9 for performer's control.

Figure 2:
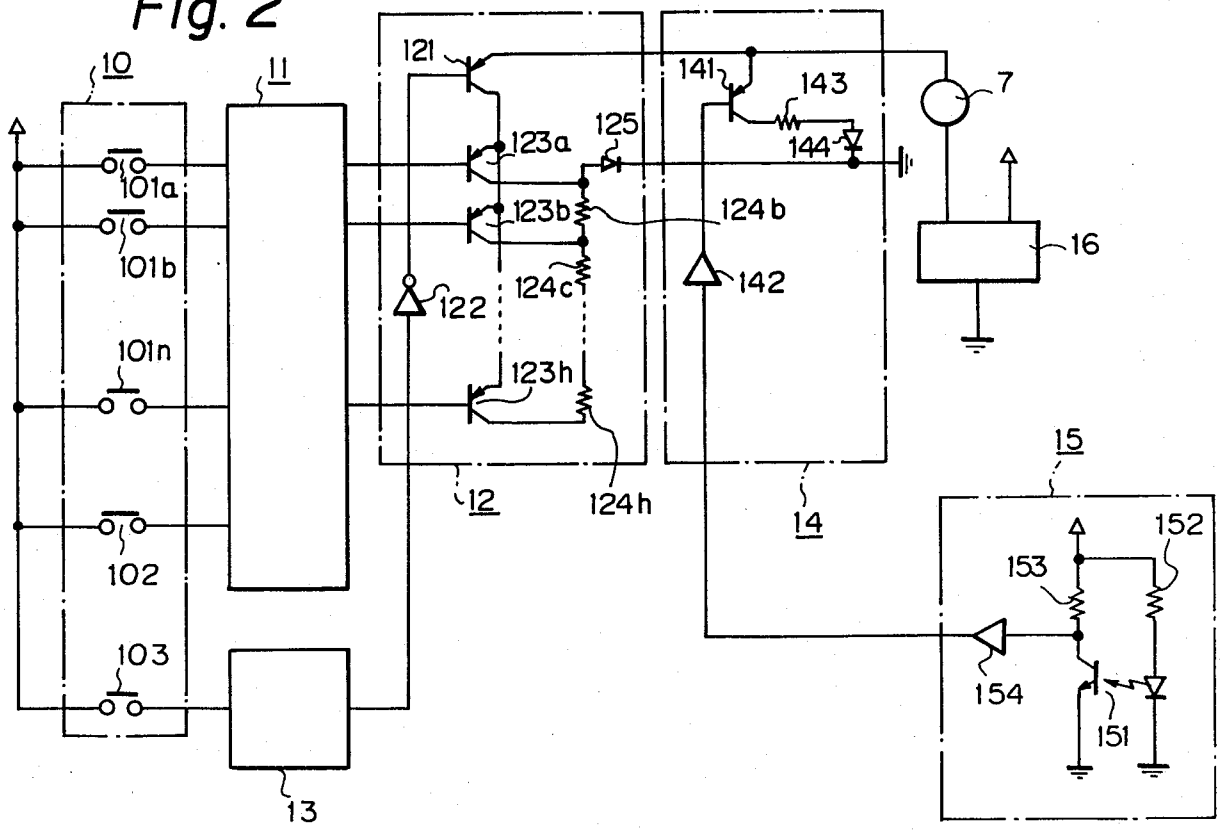
FIG. 2 is a circuit diagram of the first embodiment of the stop angle controller in accordance with the present invention.

The first embodiment of the stop angle controller in accordance with the present invention is shown in FIG. 2, in which the controller includes a speed selector 10, a speed control circuit 11 connected to the speed selector 10, a buffer circuit 12 connected to the speed control circuit 11, a pause control circuit 13 interposed between the speed selector 10 and the buffer circuit 12, a driver circuit 14 connected to the buffer circuit 12 and an angle detector circuit 15, and a power source 16.

The speed selector 10 includes speed select switches 101*a* through -101*n* for selecting the rotational speed of the drive motor 7, a stop switch 102 for stopping rotation of the drive motor 7, and a provisional stop switch 103 for provisionally stopping rotation of the drive motor 7. The switches of the speed selector 10 are collected in a common panel for easy access and operation by performers.

When one of the speed select switches 101*a* through -101*n* of the speed selector 10 is operated, the speed control circuit 11 issues a corresponding signal which is terminated when the stop switch 102 is operated. When the provisional stop switch 103 is initially operated, the pause control circuit 13 issues an output signal of level "1". When the provisional stop switch 103 is again operated, the pause control circuit 13 issues an output signal of level "0".

The buffer circuit 12 includes a transistor 121 connected to the pause control circuit 13 via an inverter 122. The buffer circuit 12 further includes transistors 123*a* to 123*h* connected, in parallel to each other, to the speed control circuit 11. The transistors 123*a* to 123*h* are accompanied, on the output side, with resistors 124*b* to 124*h* connected to each other in series. The line of resistors 124*b* to 124*h* are connected to the driver circuit 14 via a diode 125.

The driver circuit 14 includes a transistor 141 connected to the angle detector circuit 15 via a buffer 142. The output side of the transistor 141 is connected, via a resistor 143 and a diode 144, to the line from the diode 125 in the buffer circuit 12, the line being grounded. The line from the transistor 121 in the buffer circuit 12 is connected on the one hand to the transistor 141 and, on the other hand to the drive motor 7 which is in turn connected to the power source 16.

Figure 3:
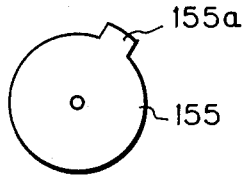
FIG. 3 is a side view of a rotary disc used for the angle detector circuit in the arrangement shown in FIG. 2, FIGS. 4 and 5 are sectional views of switches used for the arrangement shown in FIG. 2.

The angle detector circuit 5 includes a photo-interrupter 151 connected, via resistors 152 and 153, to a buffer 154 which is in turn connected to the buffer 142 in the driver circuit 14. A rotary disc 155, such as shown in FIG. 3, is arranged between a photo-diode and a photo-transistor of the photo-interrupter 151. The rotary disc 155 rotates together with the fan shift 6 and is provided with a radial projection 155*a*. The rotary disc 155 is arranged so that, upon rotation of the fan shaft, its radial projection 155*a* should provisionally interrupt a beam between the photo-diode and photo-transistor of the photo-interrupter 151 once per cycle rotation. More specifically, such beam interruption should occur when the fans are registered at a selected stop angle.

When current is supplied to the drive motor 7 through the transistor 141 of the driver circuit 14, the drive motor 7 is rotated and its rotation speed must be low enough to fully cease the rotation of the motor 7 within the beam interruption period determined by the rotary disc 155 when supply of such a current is interrupted. The level of this current is fixed by the resistor 143 in the driver circuit 14. This current will hereinafter be called "auxiliary current".

The stop angle controller of the above-described construction operates as follows.

When one of the speed select switches 101*a* to 101*n* is operated by a performer, a corresponding output signal is passed to the buffer circuit 12 from the speed control circuit 11, and a transistor corresponding to this output signal and lower order transistors in the buffer circuit 12 are all activated to pass corresponding current to the drive motor 7 which is then driven for rotation at a selected rotation speed. The level of this current is fixed by collector side resistance of the activated transistor or transistors.

When the stop switch 102 is operated in order to cease rotation of the drive motor 7, the output signal generated by the speed control circuit 11 terminates and supply of the current to the drive motor 7 from the buffer circuit 12 is interrupted so that the rotation speed of the drive motor 7 descends gradually. As long as the beam is not interrupted at the photo-interrupter 151 in the angle detector circuit 15, the angle detector circuit 15 issues a signal of level "1" which is passed to the transistor 141 of the driver circuit 14 for its activation. As described already, the auxiliary current supplied to the drive motor 7 through this transistor 141 is set to a level which causes instant stoppage of drive motor rotation upon interruption of supply of the current. So, the drive motor 7 does not cease its rotation instantly after supply of the current from the buffer circuit 12 is interrupted, but its rotation speed of the drive motor descends down to the rate fixed by the level of the auxiliary current.

The beam is provisionally interrupted at the photo-interrupter 151 once every one rotation of the fans 5. At every interruption, the angle detector circuit 15 issues an output signal of level "0". As a consequence, supply of auxiliary current through the transistor 141 of the driver circuit 14 is also intercepted once every one rotation of the fans 5. As long as the current rotation speed of the drive motor 7 is higher than the one fixed by the level of the auxiliary current, the drive motor 7 continues its rotation due to inertia despite the above-described provisional current interruption. As the provisional beam interruption by the rotary disc 155 terminates, supply of the auxiliary current to the drive motor 7 through the transistor 141 restarts.

As the supply of the auxiliary current to the drive motor 7 repeats such provisional current interruption, the drive motor 7 finally rotates at the rotation speed fixed by the level of the auxiliary current. When supply of the auxiliary current is interrupted in this state by the subsequent beam interruption at the photo-interrupter 151, the drive motor 7 instantly ceases its rotation. The moment of such auxiliary current interruption can be adjusted freely by choice in position of the radial projection 155*a* on the rotary disc, thereby enabling free adjustment in stop angle for the fans 5. Alternatively, the mode of mounting of the rotary disc 155 to the fan shaft 6 or the angular position of the rotary disc 155 with respect to the fan shaft 6 may be changed for such adjustment.

When the provisional stop switch 103 is operated, the pause control circuit 13 issues an output signal of level "1" which, after inversion at the inverter 122, deactivates the transistor 121. As a consequence, supply of current to the drive motor 7 from the buffer circuit 12 is intercepted. Thereafter, as in the case when the stop switch 102 is operated, beam is interrupted at the photo-interrupter 151 once every one inertia rotation of the fans 5. At every interruption, the angle detector circuit issues an output signal of level "0". Consequently, supply of the auxiliary current through the transistor 141 is interrupted once every inertial rotation of the fans 5. As long as the rotational speed of the drive motor 7 remains higher than the one fixed by the level of the auxiliary current, the drive motor 7 continues inertial rotation despite the provisional current interruption. After several provisional current interruption, the drive motor 7 is finally rotated at the rotation speed fixed by the level of the auxiliary current. When supply of the auxiliary current is then interrupted by the subsequent beam interruption at the photo-interrupter 151, the drive motor 7 instantly ceases rotation so that fans 5 should again be registered at the selected stop angle.

Figure 4:
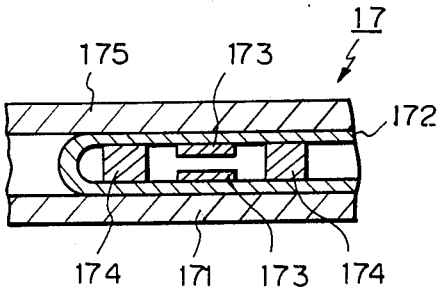
Figure 5:
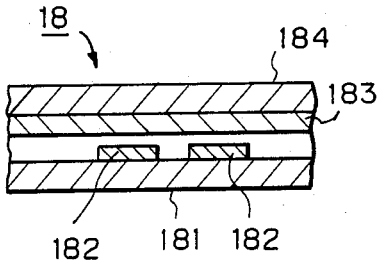

FIGS. 4 and 5 show some examples of the switches used for the speed selector 10. In FIG. 4, a switch 17 includes a substrate 171, a flexible printed circuit board 172 folded in a hairpin configuration on the substrate 171, mutually facing contacts 173 printed on the flexible printed circuit board 172, spacers 174 placed between two superposed sections of the flexible printed circuit board 172 in order to keep the contacts 173 spaced from each other, and a flexible sheet 175 covering the flexible printed circuit board 172. When no pressure is applied, the contacts 173 are kept spaced from each other so that the switch 17 should be kept open. When pressure is applied, the flexible printed circuit board 172 is contorted and the contacts 173 are brought into engagement so that the switch 17 should be closed.

In FIG. 5, a switch 18 includes a substrate 181, contacts 182 printed on the substrate 181, a pressure sensitive conductive rubber 183 spacedly placed over the contacts 182 and a flexible sheet 184 covering the rubber 183. When pressure is applied, the conductive rubber 183 is contorted to connect the contacts 182 and the switch 18 is closed.

Use of these flexible switches provides soft touch at operation, and absence of projections much improves design of the speed selector 10.

In accordance with the present invention, supply of the normal current is instantly shifted to supply of the auxiliary current when the drive motor ceases its normal rotation, supply of the auxiliary current is provisionally interrupted every time the fans assume a selected angle during inertial rotation and rotation of the drive motor is finally lowered to the rotational speed fixed by the auxiliary current so that the fans should be subsequently registered at the selected angle, i.e. the selected stop angle.

Figure 6:
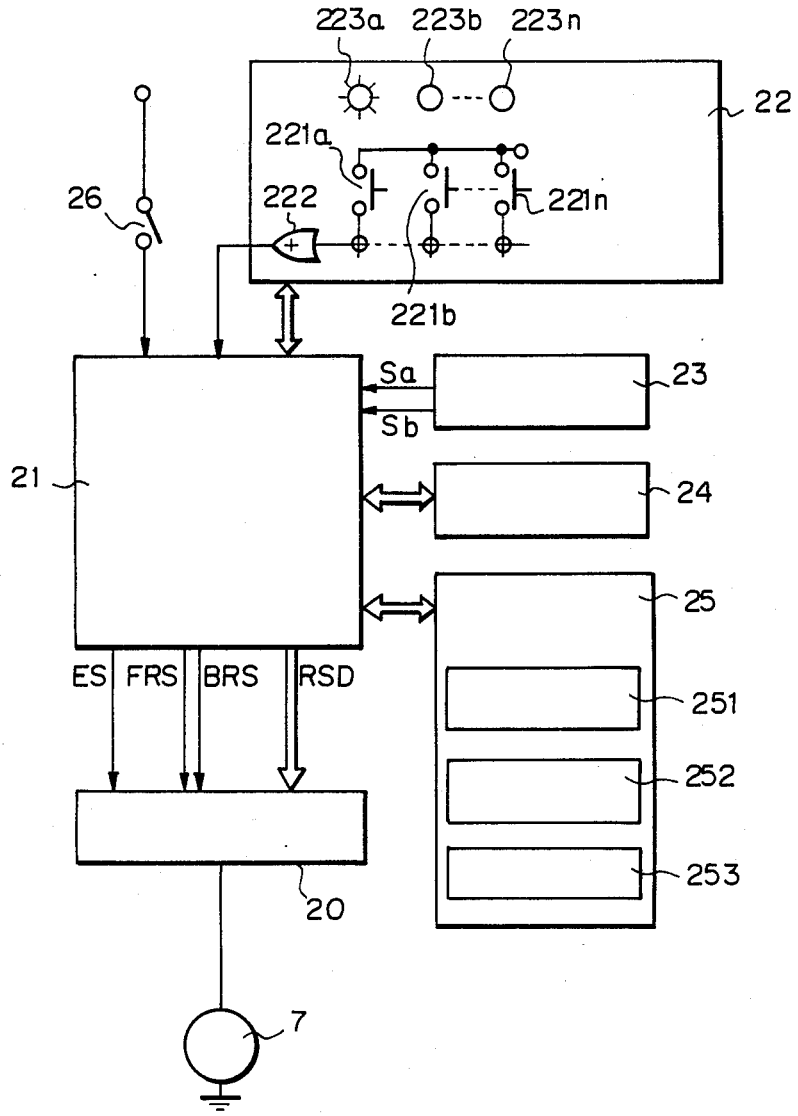
FIG. 6 is a block diagram of the second embodiment of the stop angle controller in accordance with the present invention.

FIG. 6 shows the second embodiment of the stop angle controller in accordance with the present invention. The stop angle controller includes a central processing unit (CPU)21 connected to a driver circuit 20 for the drive motor 7, a speed selector circuit 22 connected to CPU 21 for selection of rotation speed for the drive motor 7, an angle detector 23 connected to the CPU21 for detection of angular position of the fan shaft 6, a rotation speed data memory (ROM) 24 connected to the CPU21, a data memory (RAM) 25 connected to the CPU21 and a START/STOP switch 26 annexed to the CPU21.

With this construction, the angle detector 23 detects an actual stop angle of the fans 5 in order to issue two types of informative signals depending on the phase of the actual stop angle with the selected stop angle and, in response to the information signals from the angle detector 23, the CPU21 controls operation of the motor drive circuit 20 for angular correction of the fans 5.

Figure 9:
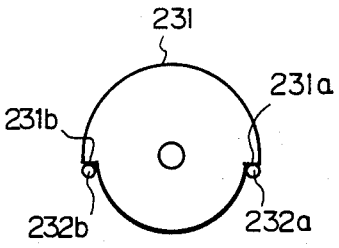

One example of the angle detector is shown in FIG. 9, in which the angle detector 23 includes a rotary disc 231 which rotates in synchronism with the fan shaft 6. Most typically the rotary disc 231 is mounted to the fan shaft 6. The rotary disc 231 is given in the form of a combination of two semicircles of different diameters. Two detector elements 232*a* and 232*b* are arranged on the opposite sides of the center of the rotary disc 231 at positions which enable the deflector element to detect passage of steps 231*a* and 231*b* which are located between the two semicircles. Under this condition, positions of the detector elements 232*a* and 232*b* are further specified so that they should align with the steps 231*a* and 231*b*, respectively, when the rotary disc 231 assumes an angular position corresponding to the selected stop angle of the fans 5. Photoelectric systems are preferably used for the detector elements 232*a* and 232*b*.

When the detector elements 232*a* and 232*b* both detect presence of a step 231*a* or 231*b* of the rotary disc 231 simultaneously, output signals Sa and Sa are both at level "1", which indicates that the angular position (actual stop angle) of the rotary disc 231 corresponds to the selected stop angle. When the detector element 232*a* only detects presence of the rotary disc 231, the output signal Sa is at level "1" and the output signal Sb is at level "0", which indicates that the angular position (actual stop angle) of the rotary disc 231 is ahead of the selected stop angle. When the detector element 232*b* only detects presence of the rotary disc 231, the output signal Sa is at level "0" and the output signal Sb is at level "1", which indicates that the angular position (actual stop angle) of the rotary disc 231 is behind the selected stop angle. These three situations are summarized in Table 1.

TABLE 1

| Sa | Sb | angular position of the rotary disc |
|---|---|---|
| 1 | 1 | selected stop angle |
| 1 | 0 | ahead of selected stop angle |
| 0 | 1 | behind selected stop angle |

The speed selector circuit 22 has a plurality of selector switches 221*a* to 221*n* arranged in parallel to each other and connected to a common OR-gate 222 which is in turn connected to the CPU21. These switches are of a self-resetting. type. The selector switches 221*a* to 221*n* are accompanied, one for each, with speed indicators 223*a* to 223*n* made of LED (light emitting diode) or the like.

The rotation speed data memory 24 is given in the form of a ROM (read only memory) and stores rotation speed data corresponding to the selector switches 221*a* to 221*n* in the speed selector circuit 22 and rotation speed data for stoppage.

The data memory 25 takes the form of a RAM (random access memory) which is made up of the first register 251 for storing rotation speed data, the second register 252 for storing a STOP-flag, and the third register 253 for storing an enable signal ES, a forward rotation signal FRS, a backward rotation signal BRS, and other signals if any.

Operation of the stop angle controller will now be explained in sequence in reference to the flow charts in FIGS. 7 and 8.

Figure 7:
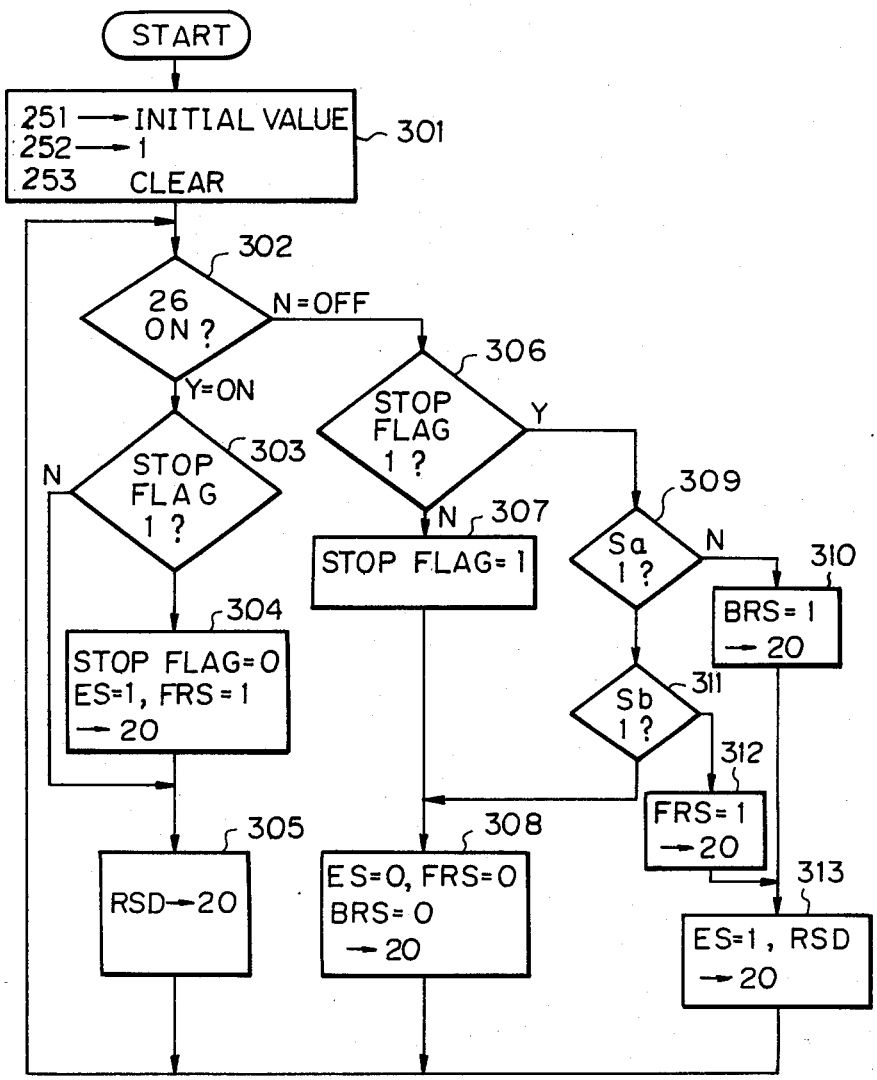
FIGS. 7 and 8 are flow charts for showing operation of the controller shown in FIG. 6, FIGS. 9 to 10C are side views of several rotary discs used for the controller shown in FIG. 6, FIGS. 11 to 13 are partly sectional side, top and front views of the third embodiment of the stop angle controller in accordance with the present invention.
Figure 8:
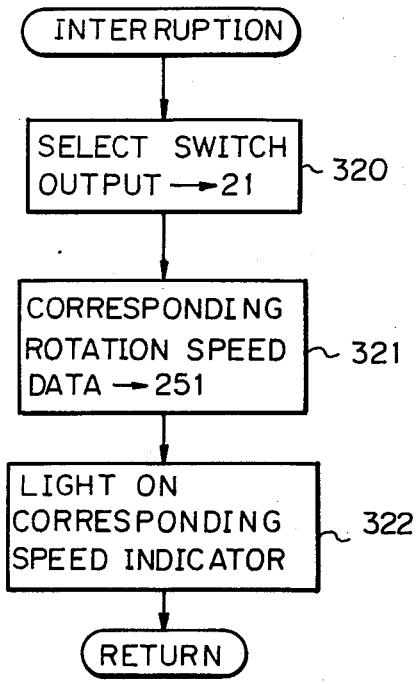

As the power source is switched on, the first register 251 in the data memory 15 is set to the initial value at step 301 in FIG. 7, the STOP-flag of the second register 252 is set to level "1", and the third register 253 is cleared.

Next, the process proceeds to step 302 whereat the state of the START/STOP switch 26 is determined. When switched on, the process proceeds to step 303. When switched off, the process proceeds to step 306.

The process develops as follows when the course of step 303 is followed. At step 303, the state of the STOP-flag is determined. When the STOP-flag is at level "1", the process proceeds to step 304. When the STOP-flag is at level "0", the process bypasses step 304. In the present case, the STOP-flag has already been set to level "1" at step 301 and, as a consequence, the process proceeds to step 304.

At step 304, the STOP-flag is set to level "0" which indicates that the START/STOP switch 26 is switched on. The enable signal ES of level "1" and the forward rotation signal FRS of level "1" are passed to the driver circuit 20 via the CPU 21.

At step 305, the register 251 passes the rotation speed data RSD to the driver circuit 20 via the CPU 21. Here, the enable signal ES enables rotation of the drive motor 7 only when it is at level "1". The forward rotation signal FRS causes forward rotation, which is same in direction as the normal rotation, of the drive motor 7 only when it is at level "1". Similarly, the backward rotation signal BRS causes backward rotation, which is opposite in direction of the forward direction, of the drive motor 7 only when it is at level "1". As a result, the drive motor 7 starts to rotate at a rotation speed indicated by the rotation speed data RSD in order to rotate the fans 5 for vibrato performance.

Thereafter, the process repeat the course including steps 302, 303 and 305 but step 304 is bypassed since the STOP-flag has already bean at level "0".

As described already, the rotation speed of the drive motor 7, i.e. the rotation speed of the fans 5, is fixed by choice of the selector switches 221*a* to 221*n* in the speed selector circuit 22. More specifically, operation on one of the selector switches 221*a* to 221*n* makes the OR-gate 222 issue a signal of level "1" which causes interruption of the CPU 21 as shown in FIG. 8. At the interruption, the CPU21 takes in the output of the operated select switch and identifies the operated switch at step 320. Next at step 321, the CPU21 reads out rotation speed data RSD corresponding to the operated select switch from the rotation speed data memory 24 in order to pass some to the first register 251 of the data memory 25. When two or more select switches are operated simultaneously, only one of them is chosen according to the prescribed order of priority and the above-described operation is carried out regarding the chosen select switch.

Thereafter the proceeds to step 322 wherein a speed indicator in the speed selector circuit 22 corresponding to the chosen switch is lighted on and the interruption terminates. Thus the selected rotation speed of the fans 5 during the vibrato performance is visually indicated.

As stated above, on operation of one of the select switches 221*a* to 221*n* in the speed selector circuit 22, a corresponding rotation speed data RSD is passed to the first register 251 in the data memory 25 via the CPU21 and stored thereat. As long as the START/STOP switch 26 remains operated, the rotation speed data stored at the first register 251 are repeatedly fed to the driver circuit 20 at step 305 in FIG. 7. Thus the drive motor 7 rotates at a rotation speed corresponding to the operated selector switch. By employment of the interruption shown in FIG. 8, rotation speed of the fans 5 can be changed as wanted by proper operation on the selector switches 221*a* to 221*n* even during vibrato performance, i.e. during rotation of the drive motor 7.

When the START/STOP switch 26 is switched off, the process proceeds from steps 302 to step 306 in FIG. 7.

At this moment, the STOP-flag is at level "0" (see step 304). The process accordingly proceeds to step 307. At step 307, the STOP-flag is set to level "1" which indicates that the START/STOP switch 26 is switched off.

Next at step 308, an enable sigual ES at level "0", a forward rotation signal FRS at level "0" and a backward rotation signal BRS at level "0" are all passed to the driver circuit 20 via the CPU21. On receipt of the signals, the drive motor 7, i.e. the fans 5, cease the rotation. Then the process proceeds back to step 302 and further to step 306 on the condition that the START/-STOP switch 26 remains unoperated. Since the STOP-flag has already been set to level "1" at step 307, the process proceeds to step 309.

In the course from step 309 to step 313, the actual stop angle of the fans 5 is corrected to the selected stop angle in reference to the output signals Sa and Sb from the angle detector 23. In the first place at step 309, the level of the output signal Sa from the detector element 232*a* is discriminated. When the output signal Sa is at level "0", the angular position (the actual stop angle) of the fans 5 is ahead of the selected stop angle and the fans 5 have to be rotated backwards. Thus, the process proceeds to step 310. When the output signal Sa is at level "1", the angular position (the actual stop angle) of the fans 5 is not ahead of the selected stop and the fans 5 need not to be rotated backwards. Thus, the process proceeds to step 311.

At step 311, the level of the output signal Sb from the detector element 232*b* is discriminated. When the output signal Sb is at level "0", the angular position (the actual stop angle) of the fans 5 is behind the selected stop angle and the fans 5 have to be rotated forwards. Thus, the process proceeds to step 312. When the output signal Sb is at level "1", the fans 5 need not to be rotated forwards. It should be noted that the output signals Sa and Sb are both at level "1" in this case. This indicates the fact that the angular position (the actual stop angle) meets the selected stop angle and no correction in angular position of the fans 5 is necessary. As a consequence, the process proceeds back to step 302 via step 308.

When the angular position (the actual stop angle) of the fans 5 is ahead of the selected stop angle at step 309, a backward rotation signal BRS at level "1" is passed to the driver circuit 20 via the CPU21 at step 310. Whereas, when the angular position (the actual stop angle) of the fans 5 is behind the selected stop angle at step 311, a forward rotation signal FRS at level "1" is passed to the driver circuit 20 via the CPU 21 at step 312. At step 313, an enable signal at level "1" and a rotation speed data RSD are passed to the driver circuit 20 via the CPU 21 at step 313. On receipt of these, the drive motor 7 rotates backwards or forwards in order to register the fans 5 at the selected stop angle at a rotation speed designated by the rotation speed data RSD. The process further proceeds to steps 302 and 306. Again at steps 309 and 311, the levels of the output signals are discriminated in order to confirm if the rotary disc 231, i.e. the fans 5, is correctly registered at the selected stop angle as a result of the correction. When the output signals Sa and Sb are both at level "1", the process proceeds to step 308 whereat rotation of the drive motor 7 is stopped. When the output signals Sa and Sb are both at level "0", the process again proceeds along the course including steps 310 or 312 and 313.

In accordance with the above-described second embodiment of the present invention, means is provided for generating a detection signal indicative of the angular position at stoppage (the actual stop angle) of the fans, and a correction current corresponding to the detection signal is supplied to the drive motor in order to register the fans by correction at the selected stop angle. Thus, the fans stop at a constant angular position at the terminals of vibrato performance, thereby always assuring uniform non-vibrato performance. If the angular position of the fans is disturbed for some reasons such as vibration of the vibraphone when they are not rotating, bias in the angular position can be instantly compensated, thereby assuring stability in construction of the vibraphone.

Figure 10A:
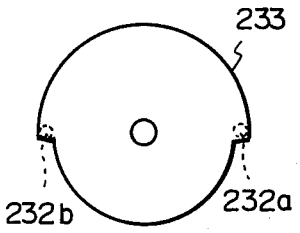
Figure 10B:
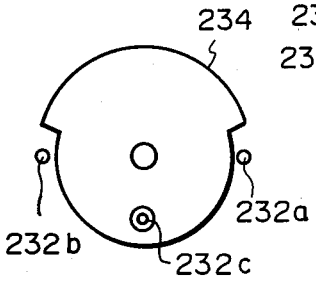
Figure 10C:
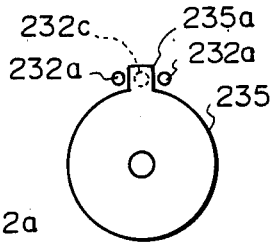

Other examples of the rotary disc are shown in FIGS. 10A to 10C. In FIG. 10A, both detector elements 232*a* and 232*b* are covered by a rotary disc 233 when the fans 5 are at the selected stop angle. Thus at step 309 in FIG. 7, level "0" of the output signal Sa is determined and, at step 311, level "0" of the output signal Sb is determined. In other words, the system is equivalent to the modification of the system in FIG. 9 in which the detector elements 232*a* and 232*b* are replaced with each other.

In the system shown in FIG. 10B, a rotary disc 234 is accompanied with an additional detector element 232*c* which is arranged at the middle on the circle connecting the detector elements 232*a* and 232*b*. In this, the direction of correction is set in reference to the output signals Sa and Sb and the output signal from the detector element 232*c* indicates whether or not the drive motor 7 should be rotated for correction.

The system in FIG. 10C is basically same as that in FIG. 10B. In this case, however, a rotary disc 235 is provided with a radial projection 235*a* for covering the detector elements.

Figure 11:
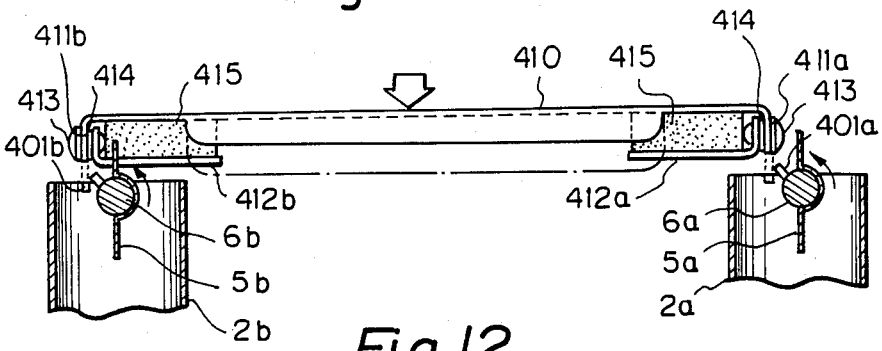
Figure 12:
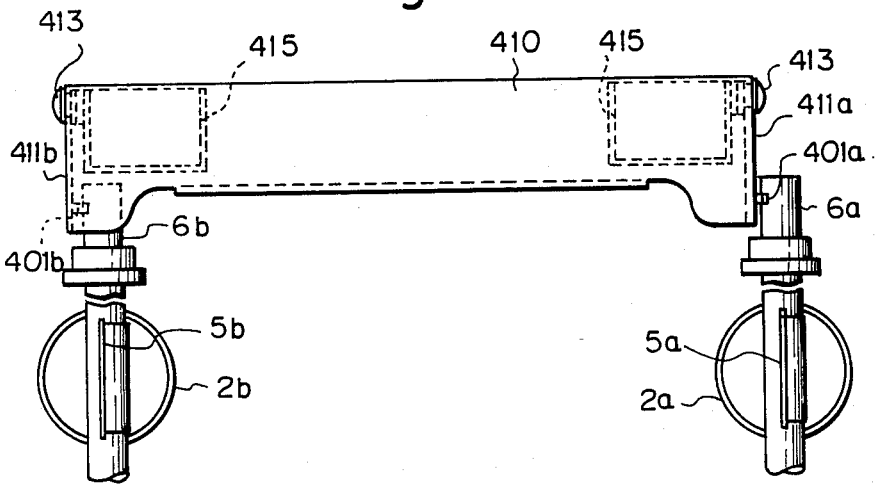
Figure 13:
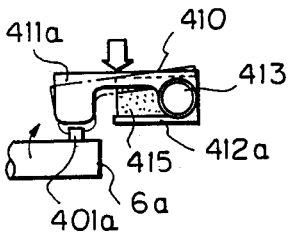

The third embodiment of the stop angle controller in accordance with the present invention is shown in FIGS. 11 to 13. Resonance tubes 2*a* (only one is shown for simplicity) are provided for fundamental tones and resonance tubes 2*b* (only one is shown for simplicity) are provided for sharps and flats. Top ends of the resonance tubes 2*a* are closed by fans 5*a* carried by a fan shaft 6*a*. Similarly, top ends of the resonance tubes 2*b* are closed by fans 5*b* carried by a fan shaft 6*b*. The fan shafts 6*a* and 6*b* are coupled to a drive motor 7 via a slippable power transmission such as a belt-pulley transmission and clutch transmission for synchronized rotation at equal rotation speed. The stop angle controller includes locker pins 401*a* and 401*b* formed at one ends of the fan shafts 6*a* and 6*b* and a locker unit 410 arranged facing the locker pins 401*a* and 401*b*. The locker pins 401*a* and 401*b* project radially from the fan shafts 6*a* and 6*b*.

The locker units 410 is given in the form of a flat plate extending between the locker pins 401*a* and 401*b* on the fan shafts 6*a* and 6*b* and, at ends facing the locker pins 401*a* and 401*b*, is provided with downwardly bent sections 411*a* and 411*b*. Near both ends of the locker unit 410, arm bases 412*a* and 412*b* are secured to the base plate 3. One ends of the bent sections 411*a* and 411*b* are pivotally coupled to top ends of the arm bases 412*a* and 412*b* via rivets 413 and bushes 414. The arm bases 412*a* and 412*b* are provided, on their top faces, with unit holders 415 such as cushions, coil springs and leaf springs in order to hold the locker unit in a substantially horizontal position. In the case of the illustrated example, sponges are used for the unit holders 415. The free ends of the bent sections 411*a* and 411*b* are located facing the locker pins 401*a* and 401*b* on the fan shafts 6*a* and 6*b*, respectively.

In this construction, the locker unit 410 is held by the unit holder 415 at a level which causes no interference of the bent sections 411*a* and 411*b* with the locker pins 401*a* and 401*b*, respectively in order to allow free rotation of the fan shafts 6*a* and 6*b* as driven by the drive motor 7. The locker pins 401*a* and 401*b* are biased over a same angle from the fans 5*a* and 5*b* in the rotational direction thereof. For example in FIG. 11, the locker pins 401*a* and 401*b* are biased in the counterclockwise direction.

When the fans 5*a* and 5*b* are rotated by the drive motor 7, the top ends of the resonance tubes 2*a* and 2*b* are continuously closed and opened for vibrato performance.

The locker unit 410 is pressed downwards as shown with chain lines in FIG. 13 when rotation of the fans 5*a* and 5*b* should be stopped. Then, the bent sections 411*a* and 411*b* descent to intrude into the rotational ambit of the locker pins 401*a* and 401*b*, respectively. As a result, the locker pins 401*a* and 401*b* engage with the bent sections 411*a* and 411*b*, respectively, to block the fan shafts 6*a* and 6*b* against further rotation. The fans 5*a* and 5*b* stop at same stop angle. In this state, rotation of the drive motor 7 is stopped and pressure on the locker unit 410 is removed. Then the locker unit 410 automatically resumes its initial position by operation of the unit holders 415 and the fan shafts 6*a* and 6*b* are released. However, since the fan shafts 6*a* and 6*b* remain standstill and maintain the looked condition, the fans 5*a* and 5*b* leave the top end of the resonance tube 2*a* and 2*b* open.

When the fan shafts 6*a* and 6*b* are blocked against rotation by the locker unit 410, corresponding impulsive load is theoretically imposed on the drive motor 7. In practice, however, use of the slippable power transmission well absorves this impulsive load in order to avoid breakage of the system.

Figure 14:
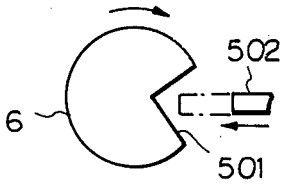
FIG. 14 is a side view of the main part of a modification of the controller shown in FIGS. 11 to 13.

Another embodiment of the stop angle controller in accordance with the present invention is shown in FIG. 14. In this case, a sector cutout 501 is formed at one end of the fan shaft 6 and an extensible locker pin 502 is arranged facing the sector cutout 501. The locker pin 502 is normally held at the position of solid lines by a suitable resilient urging means such as a spring mechanism. At transit from vibrato to non-vibrato performance, a proper drive system such as a cam-link combination urges the locker pin 502 to the position of chain lines for engagement with the sector cutout in the fan shaft.

I claim:

1. Stop angle controller for a vibrato mechanism on a vibraphone comprising:

a drive motor for driving a plurality of fans arranged on a shaft of said vibrato mechanism for common rotation, means for detecting the angular position of said fans and for generating of a detection signal as a function thereof;

means for controlling, in response to said detection signal, the operation of said drive motor to stop rotation of said fans at a selected stop angle.

2. Stop angle controller as claimed in claim 1 in which said detecting means generates said detection signal every time said fans assume a prescribed angular position during rotation, and said controlling means includes:

a stop switch;

means for intercepting supply of normal current to saaid drive motor when said stop switch is operated; and means for supplying auxiliary current to said drive motor when supply of said normal current is intercepted, supply of said auxiliary current decellerating said drive motor down to rotational speed which can be instantly stopped upon interruption of said auxiliary current, interruption of supply of said auxiliary current taking place at said supplying means upon every receipt of said detection signal from said detecting means, whereby said fans are always registered at said selected stop angle when they are stopped by said controller.

3. Stop angle controller as claimed in claim 2 in which said supplying means includes a transistor connected to a supply source of said auxiliary current, said detecting means and said drive motor, and said transistor is provisionally deactivated upon every receipt of said detection signal.

4. A stop signal controller as claimed in claim 2 in which said detecting means includes a photo interrupter which determines the angular position of said fans through beam interruption during every rotation of said fan shaft and issues said detection signal as a function thereof.

5. Stop angle controller as claimed in claim 2 in which said intercepting means includes a speed control circuit which ceases supply of said normal current upon operation of said stop switch.

6. Stop angle controller as claimed in claim 1 in which said detection signal generated by said detecting means indicates an actual stop angle of said fans, and said controlling means includes means for supplying correction current to said drive motor upon receipt of said detection signal to register said fans to said selected stop angle.

7. Stop angle controller as claimed in claim 6 in which said detecting means includes an angle detector which includes a rotary disc rotatable in synchronism with said fan shaft and a pair of detector elements arranged apart from each other in the rotary ambit of said rotary disc.

8. Stop angle controller as claimed in claim 6 in which said correction current supplying means includes a central processing unit connected to said drive motor and a data memory connected to said central processing unit, and said data memory includes a first register storing rotation speed data, a second register storing STOP-flag, and a third register for storing other data necessary for correction.

9. Stop angle controller for a vibrato mechanism on a vibraphone, comprising:

a drive motor;

a fan shaft carrying a plurality of fans and coupled to said drive motor via a power transmission; and means for locking said fan shaft against rotation through engagement with said fan shaft to stop rotation of said fans at selected stop angle.

10. Stop angle controller as claimed in claim 9 in which said fan shaft includes a radial pin arranged at its one end, and said locking means includes a member which is normally located outside the moving ambit of said pin and brought into engagement with said pin when rotation of said fans is to be stopped.

* * * * *